US005706854A

United States Patent [19]

Haynes

[11] Patent Number: 5,706,854

[45] Date of Patent: Jan. 13, 1998

[54] VENTURI VENT VALVE

[76] Inventor: George William Haynes, 101 Summit Blvd., Englewood, Colo. 80110

[21] Appl. No.: 701,118

[22] Filed: Aug. 21, 1996

[51] Int. Cl.[6] ..... F16K 15/00

[52] U.S. Cl. ..... 137/526; 137/533.25; 137/550

[58] Field of Search ..... 137/526, 533.25, 137/550

[56] References Cited

U.S. PATENT DOCUMENTS

| | | | |
|---|---|---|---|
| 1,077,415 | 11/1913 | Massey | 137/533.25 |
| 2,068,248 | 1/1937 | Schroeder | 137/526 |
| 2,732,856 | 4/1956 | Jurs et al. | 137/526 |
| 3,605,132 | 9/1971 | Lineback | 137/217 |
| 3,923,081 | 12/1975 | Persson | 137/217 |
| 4,232,706 | 11/1980 | Ericson | 137/375 |
| 4,436,107 | 3/1984 | Persson | 137/314 |
| 4,518,014 | 5/1985 | McAlpine | 137/843 |
| 4,545,398 | 10/1985 | Olst | 137/216.2 |
| 5,419,366 | 5/1995 | Johnston | 137/526 |

FOREIGN PATENT DOCUMENTS

| | | | |
|---|---|---|---|
| 499934 | 5/1919 | France | 137/533.25 |

*Primary Examiner*—Denise L. Ferensic
*Assistant Examiner*—Joanne Y. Kim

[57] ABSTRACT

A Venturi vent valve is disclosed suitable for relieving pressure differentials in sewer systems and preventing the escape of odorous gases. The valve consists of a flared tube containing a conical valve so that the annulus forms a Venturi chamber. The conical valve is mounted axially on a rod that engages in bushes attached to the tubular body and an annular base plate and constrains the valve to move axially. The conical valve rests on a rubber washer secured and sealed to the tubular body by the base plate and prevents the escape of fluids by its own weight. The conical valve lifts off the rubber washer to admit a flow of air when the pressure in the sewer system is less than ambient and the valve opening is maintained by the pressure differential, the venturi effect and the viscous forces acting on the conical valve.

1 Claim, 3 Drawing Sheets

VENTURI VENT VALVE

BACKGROUND OF THE INVENTION

1. Field of the Invention

This invention relates to a venting device for sanitation systems such as sinks, basins, tubs and toilets whereby roof vents can be eliminated and replaced with Venturi vent valves without the leaking of odorous sewer gases into the building.

2. Description of the Prior Art

The standard practice to prevent the leaking of sewer odor gases is to use U-shaped traps with the water in the trap preventing the egress of sewer gases into the building. To eliminate the siphoning of the water in the U-traps, suitable roof vents have to be provided to allow the sewer system to breathe and equalize the pressures. The installation of venting pipes is both costly and interferes with the integrity of the roof. One of the earliest solutions to this problem is the automatic plumbing vent valve (U.S. Pat. No. 3,605,132) in which a spring loaded valve opens under differential pressure and prevents the siphoning of trap water from occuring. The remaining patents cited represent refinements to the basic trap vent undoubtedly driven by the need to meet building codes. Unfortunately buildings are still constructed with roof venting pipes.

The ideal plumbing vent should open under the smallest of differential pressures and the size of the vent opening should not be dependent upon the magnitude of the differential pressure as is the case with spring loaded valves. An automatic valve device for sanitation waste pipes (U.S. Pat. No. 4,232,706) uses an annulus valve that is gravity closed and opens under differential pressure and the opening is sustained by the dynamic flow of air onto the valve annulus. This invention requires the valve to be sealed at an inner and outer radii which is difficult to achieve without sustained maintenance. Maintaining a tight seal is a principal fault with many of the patents cited.

SUMMARY OF THE INVENTION

The object of this invention is to produce an automatic venting device of simple design that is:

(a) Virtually maintenance free (b) The valve is sealed at a single radius (c) The valve is closed under gravity and rests on a rubber washer which is easily replaceable (d) The valve is opened by low differential pressure and the opening sustained by the venturi induced pressure and the viscous flow of air over the valve.

(e) To minimise pressure losses, the inlet areas should be large.

Basically the device consists of a flared tubular body that contains a conical valve mounted on a rod. The rod constrains the valve to move up and down by engaging in an annular bushing secured to the tubular body and another annular bushing secured to the base plate which attaches to the rear of the body. The base plate also secures a rubber washer to the body upon which the conical valve rests. Under differential pressure, air passes through the openings in the base plate and raises the conical valve. The annulus between the flared tubular body and the valve cone forms a venturi chamber so that the induced pressure reduction, together with the viscous forces acting on the cone surface, maintain the valve opening at very low differential pressures. To prevent the conical valve from completely rising in the flared cylindrical body and closing off the flow of air, suitable spacers have to be provided to maintain a minimum air gap. The air gap should be small enough to increase the flow velocity sufficiently to create a venturi effect but not small enough to make the viscous pressure loss prohibitive.

DESCRIPTION OF THE PREFERRED EMBODIMENTS

Figure 1:
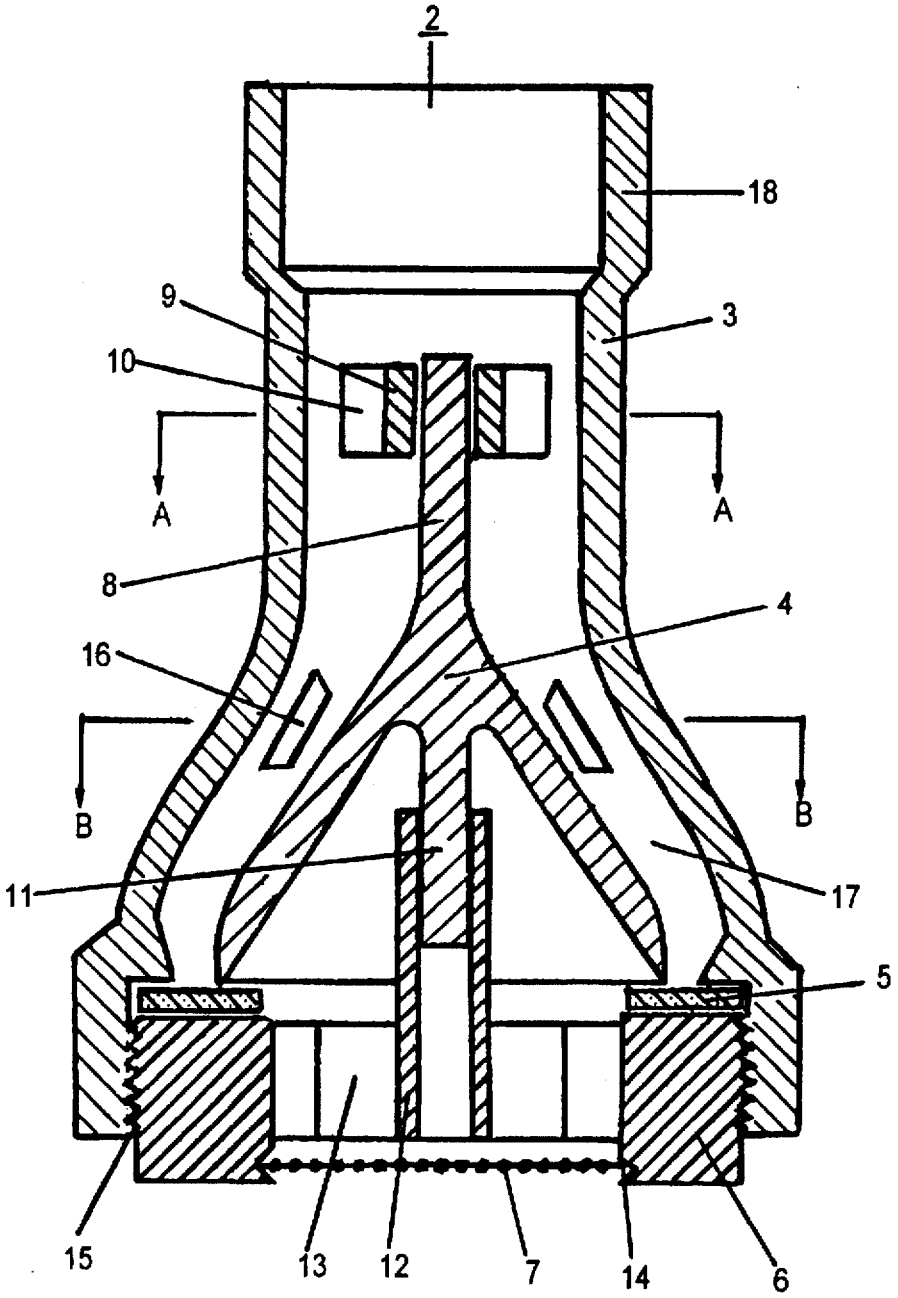
FIG. 1 is a cross-section of the device showing a flared tubular body, a conical valve, a base plate, a rubber washer and a wire screen.
Figure 2:
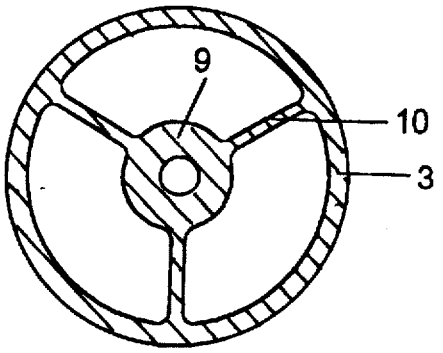
FIG. 2 is a cross-section of the tubular body at point A showing the valve constraining guide.
Figure 4:
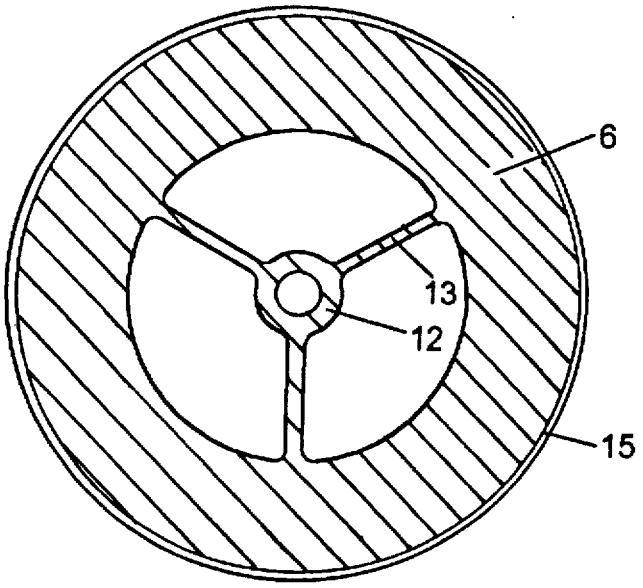
FIG. 4 is a plan of the base plate.

Referring to FIG. 1, the device 2 consists of a flared tubular body 3, a conical valve 4, a rubber washer 5, a base plate 6 and a wire screen 7. The conical valve 4 is attached to a rod with ends 8 and 11. The conical valve is constrained to axial motions by the guide 9 attached to the tubular body 3 by the fins 10 (FIG.2) and accepts the rod end 8. Similarly, the guide 12 attached to the base plate 6 by the fins 13 (FIG. 4) accepts the rod end 11. The base plate 6 is secured to the tubular body 3 by means of a screw thread 15. The base plate 6 secures and seals the rubber washer 5 to the tubular body 3. The valve 4 sits on the rubber washer 5 and maintains a seal under its own weight. The main annulus of the base plate 6 has a groove 14 which accepts a wire screen 7 to prevent the integrity of the device 2 from being corrupted by insects. The top of the device 2 has a connection 18 that accepts standard plumbling pipe for interfacing the Venturi vent valve to the sanitation system.

Figure 3:
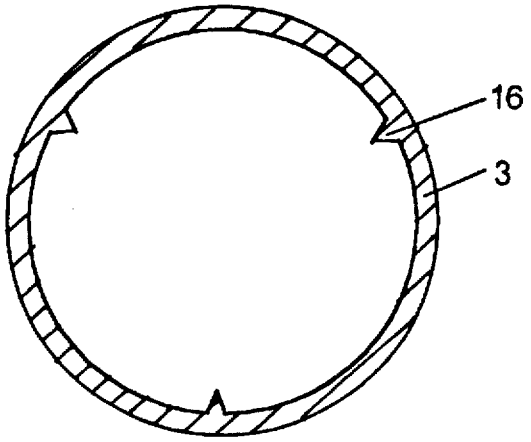
FIG. 3 is a cross-section of the tubular body at point B showing fins to maintain the venturi cavity.

When a siphon differential pressure occurs, the conical valve 4 rises so that air enters the sanitation system. Spacer fins 16 (FIG. 3) attached to the tubular body 3 are provided to prevent the conical valve 4 from completely closing off the venturi chamber 17.

Figure 5:
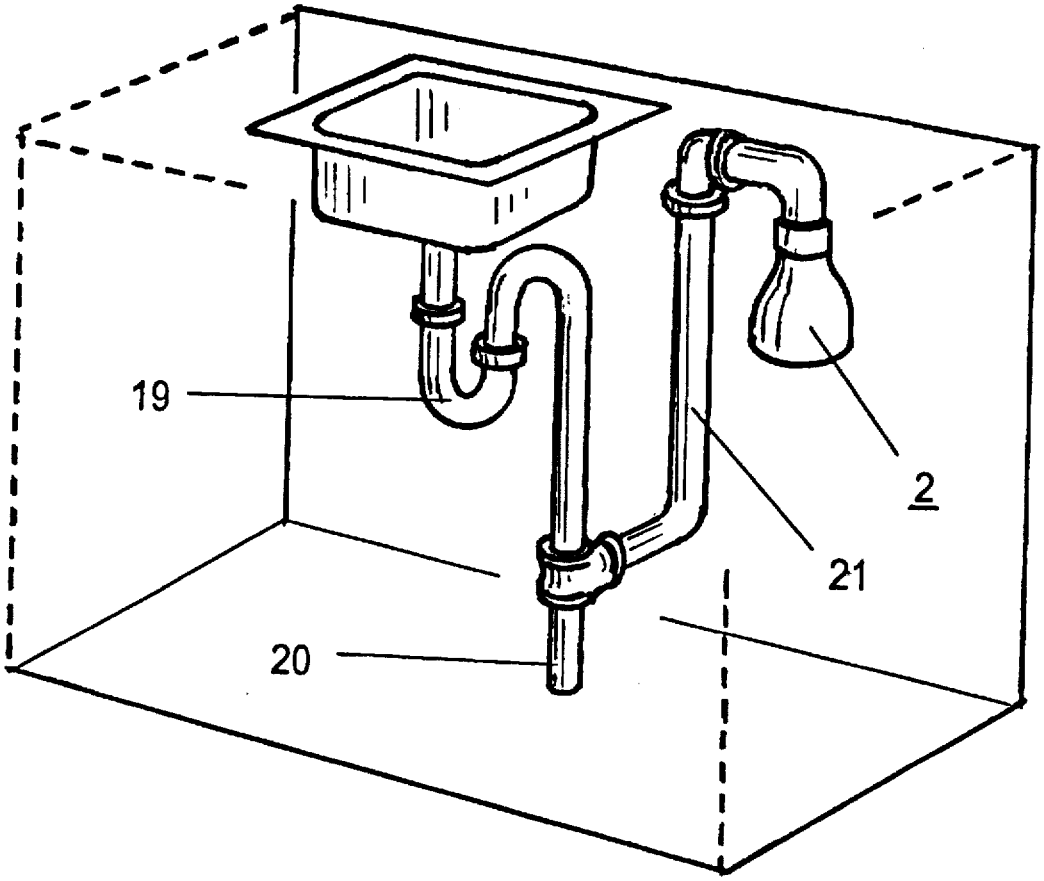
FIG. 5 shows a typical bathroom application of the Venturi vent valve.

The device 2 is attached (FIG. 5) to the sanitation system 20 by appropriate pipe connections below the trap 19 with a sufficient length of pipe 21 to prevent backflow of water into the device 2 when draining water into the sanitation system. In a similar fashion the device 2 can be attached to major sewer lines. Furthermore, since this valve concept is based on pressure differentials and areas, the concept can be scaled to any application. The design presented, was based on the pipe connection 18 accepting the standard plumbing plastic 1⅞ inch pipe.

The tubular body 3, the conical valve 4 and the base plate 6 of the device 2 can be constructed from poly-vinyl-chloride (PVC) or acrylonitrile-butadene-styrene (ABS) plastic.

Thus, there has been shown and described a Venturi vent valve capable of operating under very small differential pressures.

What is claimed is:

1. A Venturi vent valve that when connected to a sewer system prevents the escape of odorous gases and equalizes the pressure in the sewer system, the said valve including:

a flared tubular body containing a conical valve thus forming an annular venturi chamber, said conical valve is connected axially to a rod which engages in annular bushes connected to the tubular body and to an annular base plate that is secured to the tubular body and constrains the conical valve to axial motions, said annular base plate attaches and seals a rubber washer to the tubular body upon which the conical valve rests under its own weight and prohibits the escape of fluids, said conical valve lifts off the rubber washer when a reduced pressure exists in the sewer system and admits air flow until the pressure is equalized, said movement of the conical valve is governed by the pressure differential of the sewer system to the ambient pressure, the pressure drop induced by the venturi effect, the viscous force effect of the air flow, and is limited by spacers attached to the tubular body, said annular base plate is grooved to accept a disc of wire screen to protect the valve from contaminants.

* * * * *